United States Patent [19]

Terpay

[11] 4,282,011

[45] Aug. 4, 1981

[54] WOVEN FABRICS CONTAINING GLASS FIBERS AND ABRASIVE BELTS MADE FROM SAME

[75] Inventor: John M. Terpay, Danville, Va.

[73] Assignee: Dan River Incorporated, Danville, Va.

[21] Appl. No.: 154,996

[22] Filed: May 30, 1980

[51] Int. Cl.[3] ..... B24D 3/00; B24D 11/00

[52] U.S. Cl. ..... 51/298; 51/293; 139/420 C; 428/241; 428/245; 428/257; 428/258; 428/259

[58] Field of Search ..... 428/240, 241, 242, 244, 428/245, 251, 252, 257, 258, 259, 262; 51/293, 298, 309, 294; 139/420 C

[56] References Cited

U.S. PATENT DOCUMENTS

| | | | |
|---|---|---|---|
| 2,138,882 | 12/1938 | Robie | 51/404 |
| 2,329,452 | 9/1943 | Bloch | 139/426 R |
| 2,370,946 | 3/1945 | Finlayson et al. | 428/258 |
| 2,372,983 | 4/1945 | Richardson | 206/524.9 |
| 2,400,327 | 5/1946 | Womble | 139/426 |
| 2,404,207 | 7/1946 | Ball | 51/188 |
| 2,477,407 | 7/1949 | Grant et al. | 428/251 |
| 2,672,715 | 3/1954 | Walters | 51/188 |
| 2,740,239 | 4/1956 | Ball et al. | 51/185 |
| 2,763,105 | 9/1956 | Feeley | 51/207 |
| 2,808,688 | 10/1957 | MacMaster | 51/193 |
| 2,951,277 | 9/1960 | Youngs | 28/78 |
| 3,073,004 | 1/1963 | Zeise | 28/80 |
| 3,146,560 | 9/1964 | Hurst | 51/188 |
| 3,597,887 | 8/1971 | Hall | 51/295 |
| 3,688,453 | 9/1972 | Legacy et al. | 51/404 |
| 3,695,326 | 10/1972 | Bryant et al. | 152/358 |
| 3,706,167 | 12/1972 | Schaffner | 51/394 |
| 3,707,120 | 12/1972 | Schroeder | 428/257 |
| 3,787,224 | 1/1974 | Uffner | 57/153 |
| 3,787,273 | 1/1974 | Okrepkie et al. | 51/297 |
| 3,855,678 | 12/1974 | Schroeder | 28/166 |
| 3,919,018 | 11/1975 | Schroeder | 156/85 |
| 4,001,477 | 1/1977 | Economy et al. | 428/225 |
| 4,073,330 | 2/1978 | Allard | 152/359 |
| 4,103,102 | 7/1978 | Klein | 57/238 |

*Primary Examiner*—James J. Bell

*Attorney, Agent, or Firm*—Fisher, Christen & Sabol

[57] ABSTRACT

A woven fabric comprising glass fibers cushioned from each other by organic fibers in the warp direction, the sinuosity of the glass fibers being less than or equal to the sinuosity of the organic fibers for a given length of woven fabric, and organic fibers in the fill direction has an extremely low degree of stretchability in the warp direction and exhibits high strength under tension in the warp direction. Abrasive belts comprising the woven fabric coated with an adhesive containing abrasive particles exhibit close to zero elongation, have long lives and can be repeatedly used for debarking logs.

13 Claims, 9 Drawing Figures

WOVEN FABRICS CONTAINING GLASS FIBERS AND ABRASIVE BELTS MADE FROM SAME

BACKGROUND OF THE INVENTION

1. Field of the Invention

This invention relates to extremely strong woven fabrics which give close to zero elongation in one direction. This invention also relates to abrasive belts made from said woven fabrics.

2. Description of the Prior Art

The extremely low elongation or yielding and extremely high strength under tensional stress, the substantially 100% elasticity, and the high resistance to heat exhibited by glass fibers have resulted in their increasing use in textiles which are subjected to dynamic stresses and/or high temperatures. For example, textiles which contain glass fibers are used as reinforcing materials for elastomeric products such as tires, industrial belts, mountings, shock absorbers and the like. For example, U.S. Pat. No. 3,695,326 teaches a tire fabric comprising glass fibers warp and weft which are bonded at their crossover points with a thermoplastic resin to preclude movement between the warp and fill fibers. The bond is treated with a resorcinol-formaldehyde reaction product for subsequent bonding to tire rubber. U.S. Pat. No. 4,073,330 teaches tire cord fabrics comprising alternating steel and glass fibers in the warp direction and synthetic fibers in the weft direction. The weft fiber is optional. U.S. Pat. No. 3,787,224 discloses glass fiber-reinforced elastomeric products wherein the glass fibers are coated with a specific resorcinolaldehyde composition to enhance bonding with the elastomeric material. U.S. Pat. No. 4,103,102 discloses a polyester/glass woven fabric which is impregnated with resin and used in wiring boards. U.S. Pat. No. 4,001,477 discloses phenol-formaldehyde fibers which are woven with glass fibers to produce a flame resistant fabric for the manufacture of clothing. However, these fabrics are either too stiff, would elongate excessively, would self-destruct, or are too bulky for the production of industrial belts which are subjected to high speeds and high horsepower, or for the production of abrasives which are suitable for precision abrading operations.

The use of textiles, both woven and nonwoven, which contain glass fibers in the production of polishing and abrasive products such as burnishing wheels, abrasive belts and abrasive disks is well-known. U.S. Pat. Nos. 2,404,207, 2,808,688 and 3,146,560 disclose abrasives which contain nonwoven glass fibers. U.S. Pat. No. 2,763,105 discloses a burnishing wheel comprising a glass fabric impregnated with a thermosetting resinous binder. However, these abrasives are either not flexible or, if flexible, elongate excessively or disintegrate rapidly upon use in abrasive operations. They are not well suited for precision grinding and require subsequent costly milling operations.

Abrasive belts comprising glass fabrics which are coated with a phenol-formaldehyde resin and abrasive particles are disclosed in U.S. Pat. Nos. 2,138,882 and 2,740,239. In the latter patent, the use of one fiber type is preferred so as to eliminate differences in strength. However, abrasive belts which contain only glass fibers in both the warp and fill directions are rapidly destroyed in heavy abrasive operations, such as the debarking of logs, because adjacent glass fibers rub each other along their length resulting in breakage of the glass fibers. Also, glass fibers which are transverse to each other tend to cut each other at crossover points. The use of synthetic fibers in the fill direction to reduce destruction of warp glass fibers at crossover points is disclosed in U.S. Pat. Nos. 2,372,983, 2,477,407 and 3,073,004. However, the warp glass yarns can still cut each other due to rubbing along their length.

Replacement of a portion of the warp fibers of a woven, non-glass fiber fabric to increase the wet strength of the fabric is disclosed in U.S. Pat. Nos. 2,329,452, 2,370,946 and 2,400,327. In U.S. Pat. No. 2,329,452 the wet strength is increased and the stretch or shrinkage factor is kept below 1 to 2% in a textile fabric by alternating cotton and spun rayon threads in the warp direction. In U.S. Pat. No. 2,370,946 fabrics are oiled or varnished to render them suitable for electrical insulating purposes. Yarns of high extensibility and yarns of low extensibility in both the warp and weft directions are alternated to minimize tearing due to cutting action between the stronger yarns. U.S. Pat. No. 2,400,327 teaches that the wet strength of rayon fabric is increased by alternating rayon fibers with another fiber such as cotton in the warp direction. However, without glass fibers, the fabrics of these patents would elongate, and thus be unsuitable for the manufacture of abrasive belts used for debarking logs and other purposes where low-stretch is essential for abrasive belts.

Abrasive and polishing materials which contain woven non-glass fabrics are disclosed in U.S. Pat. Nos. 2,672,715, 3,597,887, 3,688,453, 3,706,167 and 3,787,273. U.S. Pat. No. 3,597,887 discloses a buffing wheel comprising a fiberglass mesh impregnated with an abrasive-containing foamed adhesive. U.S. Pat. No. 3,706,167 discloses a flap wheel comprising a woven fabric, and an abrasive material coated thereon. In U.S. Pat. No. 2,672,715 crimps are made in the longitudinal strands of the abrasive belt so as to reduce stretching of the belt. U.S. Pat. No. 3,688,453 discloses an abrasive belt having a woven scrim cloth backing which may be of polyester or nylon. A non-woven layer is laminated on the woven layer. A resin containing an abrasive impregnates the woven and non-woven layers. It is disclosed that the abrasive belt should not stretch more than 5 percent. U.S. Pat. No. 3,787,273 discloses an abrasive belt having low stretch characteristics wherein a heavy woven fabric is used as a backing for the belt. However, these products do not possess the close to zero elongation and high strength which can be achieved with woven fabrics which contain glass fibers in the direction of tensional stress.

Glass fabrics comprising glass fibers and synthetic fibers in one direction are disclosed in U.S. Pat. Nos. 2,951,277, 3,707,120, 3,855,678 and 3,919,018. In U.S. Pat. No. 2,951,277 a fabric having controlled stretch is achieved with synthetic fibers and glass fibers in the warp direction. U.S. Pat. Nos. 3,707,120, 3,855,678, and 3,919,018 (all to C. F. Schroeder) teach a woven sheet, good for the reinforcement of rubber products, such as industrial belts, wherein warp glass filament strands are spaced regularly between warp strands of extensible organic filaments and all weft or fill strands are of an organic material such as nylon. The glass strands are impregnated with an organic resin latex containing resorcinol-formaldehyde resin. The fabric features a pattern of weave characterized in that the glass fibers in the warp direction exhibit a frequency of ups and downs which is greater than the frequency of ups and downs of the yarns of greater extensibility in the warp direction.

As a result, the fabric stretches in the warp direction until the glass fibers are straight, or in alignment with the direction of tensile force. Abrasive belts made with stretchable fabrics such as disclosed in U.S. Pat. No. 2,951,277 and in the Schroeder patents would not exhibit the close to zero elongation which is needed for highly precise abrasion operations.

According to the present invention, there is provided a fabric which exhibits close to zero elongation and extremely high strength under tensional forces. The present invention also provides abrasive products which exhibit close to zero elongation, high strength and long lives even when used in vigorous abrading operations such as the debarking of logs.

SUMMARY OF THE INVENTION

The present invention relates to a woven fabric having an extremely low elongation in the warp direction. The close to zero elongation is achieved by the use of alternating glass fibers and organic fibers in the warp direction wherein the sinuosity of the glass fibers in a given length of the woven fabric is less than or equal to the sinuosity of the organic fibers. The organic fibers in the warp direction cushion the glass fibers from each other and prevent the glass fibers from destroying each other under dynamic conditions. Considered in an unwoven state, the length of the glass fiber in a given increment of length of the woven fabric is less than or equal to the length of the organic fibers in the same increment of length of the woven fabric. Abrasive belts comprising the woven fabric coated with an adhesive which contains abrasive particles have very low extensibility and long lives even when used in debarking operations.

BRIEF DESCRIPTIONS OF THE DRAWINGS

The invention is illustrated in the accompanying drawings wherein:

FIG. 1 schematically shows a weave pattern which embodies features of the present invention.

Figure 7:
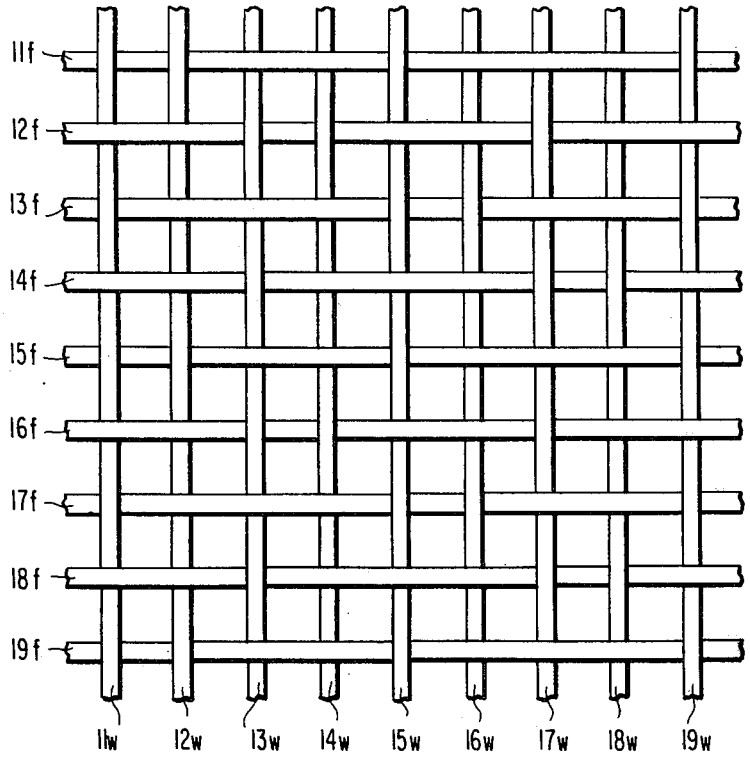

FIG. 7 schematically shows another weave pattern which can be used to accomplish the objectives of the present invention.

Figure 8:
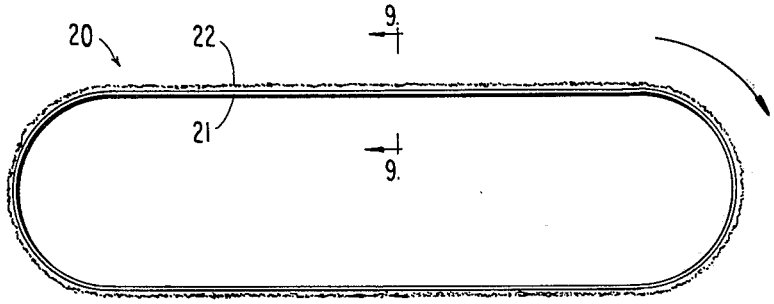

FIG. 8 schematically shows an endless abrasive belt according to the present invention.

Figure 9:
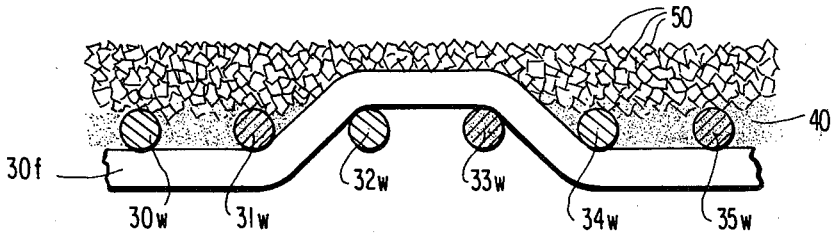

FIG. 9 is a sectional view, taken in direction 9—9 of FIG. 8, of a portion of the width of the endless abrasive belt of FIG. 8.

DETAILED DESCRIPTION OF THE INVENTION

The woven fabric of the present invention comprises alternating glass fibers and organic fibers in the warp direction and organic fibers in the fill direction. For a given length of woven fabric in the warp direction, the sinuosity of the glass fibers in the warp direction is less than or equal to the sinuosity of the organic fibers in the warp direction. As used herein, the terms fiber and fibers include monofilaments and multifilament yarns. Both the glass fibers and the organic fibers used in the present invention are preferably multifilament yarns because of their greater strength and their better ability to bond to resins.

Commercially available coated glass yarns, such as those used in the manufacture of glass-belted tires or carpet backing are suitable for the woven fabrics of the present invention. The glass fibers employed in the present invention are preferably coated before being woven. A conventional resorcinol-formaldehyde latex is appropriate.

Treatment of the glass filaments as they are formed is typical. In one such treatment, the filaments are sprayed with a liquid composition containing an anchoring agent such as an aminosilane when they are collectively drawn from the conventional multi-orifice platinum bushing containing the molten glass. A single glass filament is pulled from each of these orifices by a winder situated below. The pulling attenuates the glass into filaments of extremely fine diameter. The filaments are drawn together into a common strand just prior to being wound on the spool. The anchoring agent is sprayed onto the filaments just prior to their being gathered together. Suitable anchoring agents include gamma-aminopropyltriethoxy silane; a mercapto substituted organoalkoxy silane; a glycidoxy silane, such as gamma-glycidoxypropyltrimethoxy silane; or a carboxyl group and/or unsaturated group containing silane, such as gamma-methacryloxypropyltrimethoxy silane. A Werner type compound complexed to contain an amino, a carboxyl or other active hydrogen containing organic group may also be used as the anchoring agent. A typical treatment composition is composed of 0.5–2.0 percent by weight of gamma-aminopropyltriethoxy silane, 0.3–0.6 percent by weight of a lubricant and the remainder water. The treated strand on the spool package is frequently combined with a plurality of like strands to form a yarn. For example, a plurality of from 2 to 10 strands, each composed of several hundred glass filaments, are combined, usually with some amount of twist, to form a strand suitable for use as a component of the present invention. The glass strand may also be formed of a combination of multiple yarn subassemblies; each of the subelement yarns being formed of several hundred glass filaments so that the combined yarn is a multiple of the subelements. Suitable glass fiber thicknesses are in the range of about 1000 denier to 3500 denier.

After treatment with the anchoring agent, it is preferable to impregnate or coat the glass fibers with a resin as is conventionally done in the manufacture of glass fibers used in carpet backing or glass-belted tires. The impregnated glass fibers can then be woven with the organic fibers to form a fabric of the present invention. A suitable impregnant bath is composed of 60–40 parts by weight of a 38 percent dispersed solids system including a butadiene-styrene-vinyl pyridine terpolymer latex, a butadiene styrene latex and a resorcinol-formaldehyde resin, all dispersed in 39 parts by weight of water. A commercially available product which has been employed as an impregnant bath in the manufacture of combination yarn materials is marketed by Uniroyal under the trade name LOTOL 5440. Impregnation of the treated glass fibers is suitably achieved by passing them through a bath of the impregnant which is metered on the fiber by passing the impregnated fiber through a wiping die. The thickness of the impregnated glass fibers is preferably within the range of 1000 denier to 4500 denier, most preferably about 3300 denier.

The glass fibers which have been treated with the anchoring agent could first be woven with the organic fibers into a fabric. The fabric could then be immersed in the impregnation bath.

The impregnated fibers or impregnated fabric is heated to dry the impregnant and to cure the resin. Drying and curing temperatures and times are those conventionally used in the impregnation or coating of glass fibers with resins in the manufacture of glass tire cords. The degree of drying and curing should render the product suitable for further processing, such as the weaving step. The drying and heating of the impregnated glass fibers or impregnated fabric is typically performed at about 600° F.–900° F. for about one minute or less in a horizontal oven.

The organic fibers used in the warp and fill directions may be the same or different, synthetic or natural occurring fibers. Exemplary of the organic fibers useful in the present invention are cotton fibers, polyester fibers, polyester-cotton blend fibers, nylon fibers, wool, acrylic fibers, acetate fibers and mixtures thereof. The organic fibers must provide a cushioning effect upon the glass fibers. Also, the organic fibers should exhibit strong adhesiveness to the abrasive-containing adhesive used in the production of the abrasive belts of the present invention. Thus, the woven fabric of the abrasive belts of the present invention preferably contain textured organic yarns or spun organic yarns in the warp and fill directions because of their better adhesion characteristics and their greater softness over monofilament yarns. Most preferably, spun yarns of 50% cotton and 50% polyester are used in the warp direction to cushion the glass fibers from each other along their length and 100% spun polyester yarns are used in the filling direction. The cotton count of the organic spun fibers used in making the fabrics of the present invention are suitably in the range of 8s/l to 2s/l.

To add extra strength and reduce elongation in the fill direction, a glass yarn could be substituted for every third, or sixth, or 24th filling yarn. However, the greater the number of glass filling yarns used, the greater the risk of destruction of the glass fibers at the points where the glass fibers cross over each other. Thus, where very long lives are desired, the fabric should contain only organic yarns in the fill direction.

The fabric of the present invention has been described as having the alternating glass fibers and organic cushioning fibers in the warp direction and organic fibers in the fill direction wherein the sinuosity of the glass fibers in the warp direction is less than or equal to the sinuosity of the organic fibers in the warp direction for a given length of fabric. However, the fabric can likewise comprise alternating glass and organic cushioning fibers in the fill direction, and organic fibers in the warp direction, the sinuosity of the glass fill fibers being less than or equal to the sinuosity of the organic fill fibers for a given increment of length in the fill direction.

The fabrics of the present invention can be woven on conventional dobby machines, Jacquard looms and the like. The amount of fiber used in making the fabric of the present invention depends upon the intended end use of the fabric. In the case of abrasive belts, the fabric should have a substantially closed weave. The fabrics of the abrasive belts of the present invention typically contain about 34 warp yarns per inch, equally divided between the glass fibers and organic cushioning fibers, and about 24 organic fill yarns per inch, the glass fiber warp yarns being about 2700 denier before coating and 3300 denier after coating and the fill yarns being from about 2s/l to 8s/l total cotton count regardless of whether the yarns are single or plied.

Figure 1:
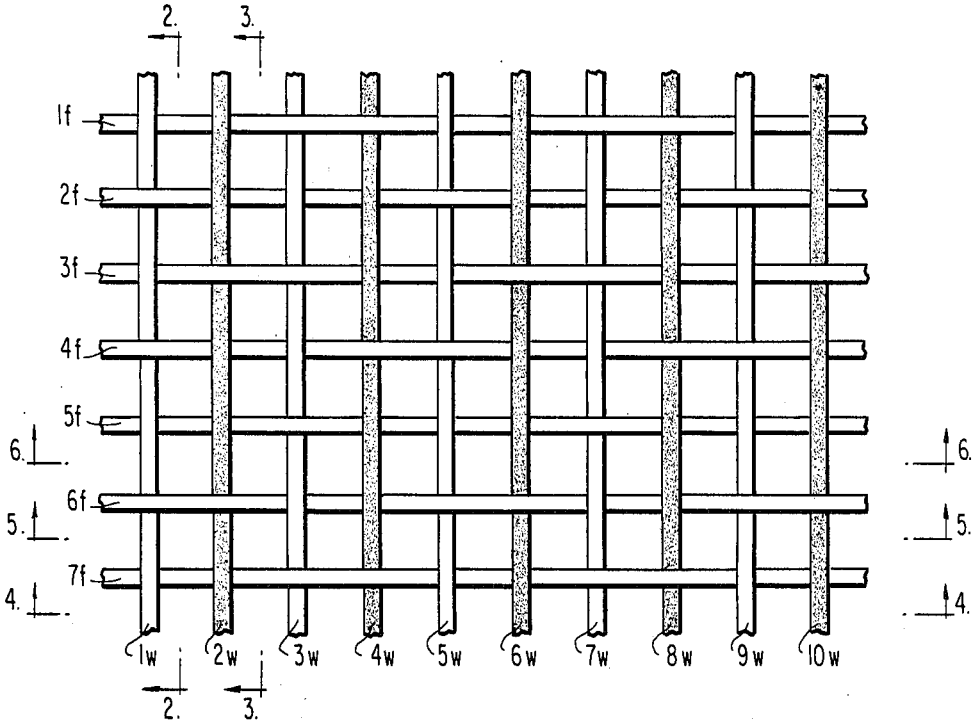
Figure 2:
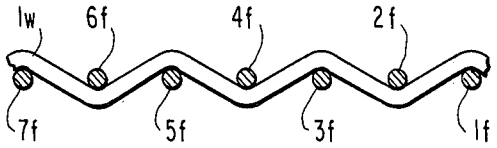
FIG. 2 is a sectional view taken on line 2—2 of FIG. 1.
Figure 3:
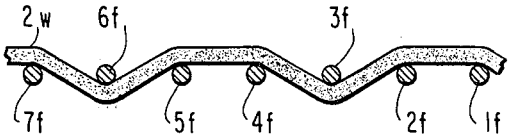
FIG. 3 is a sectional view taken on line 3—3 of FIG. 1.

A woven fabric which embodies features of the present invention is shown schematically in FIG. 1 and various cross sections of the fabric are shown in FIGS. 2–6. In FIG. 1 the warp fibers extend vertically and are identified by the reference numerals 1*w*, 2*w*, 3*w*, 4*w*, 5*w*, 6*w*, 7*w*, 8*w*, 9*w*, and 10*w*. Organic fibers 1*w*, 3*w*, 5*w*, 7*w*, and 9*w* alternate with and thereby cushion glass fibers 2*w*, 4*w*, 6*w*, 8*w*, and 10*w*. The organic warp fibers are more sinusoidal than the glass warp fibers for a given increment of length of the fabric in the warp direction. This greater sinuosity can be readily seen by comparing FIGS. 2 and 3 which are cross sections along the length of adjacent fibers 1*w* and 2*w* in FIG. 1. As shown in FIG. 2, organic fiber 1*w* goes over one fill fiber and then under the next fill fiber and so on. As shown in FIG. 3, glass fiber 2*w* goes under one fill fiber and then over two adjacent fill fibers and so on. Thus, the warp fiber 1*w* in the unwoven condition is longer than the glass warp fiber 2*w* because its pattern of weave is more convoluted than the warp fiber 2*w*. If the warp fibers 1*w* and 2*w* as shown were removed from the segment of woven material as shown and straightened out into unwoven configuration, the warp fiber 1*w* would be longer than the warp fiber 2*w*. It will further be appreciated that tension imposed on a fabric composed of a plurality of warp fibers 1*w* and 2*w* in side-by-side, alternating relationship would result in the load being borne by the glass warp fibers 2*w* since they are the shorter of the two.

Figure 4:
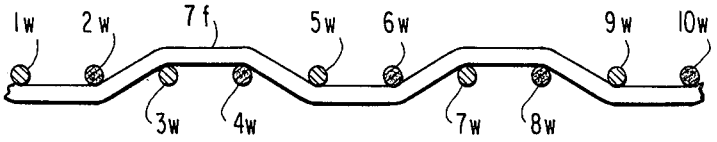
FIG. 4 is a sectional view taken on line 4—4 of FIG. 1.
Figure 5:
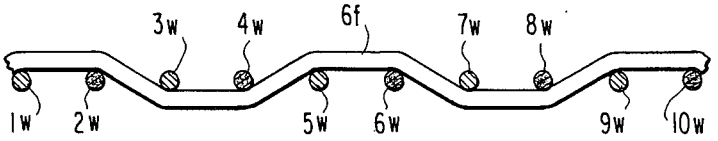
FIG. 5 is a sectional view taken on line 5—5 of FIG. 1.
Figure 6:
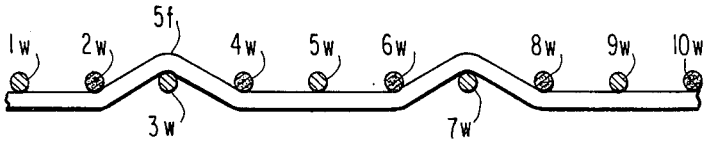
FIG. 6 is a sectional view taken on line 6—6 of FIG. 1.

The organic fill fibers in FIG. 1 are identified by the reference numerals 1*f*, 2*f*, 3*f*, 4*f*, 5*f*, 6*f*, and 7*f*. Cross sections taken along the lengths of fill fibers 7*f*, 6*f* and 5*f* are shown in FIGS. 4, 5, and 6 respectively. As shown in FIGS. 4 and 5, fill fibers 6*f* and 7*f* go over adjacent organic and glass warp fibers and then over the next pair of organic and glass warp fibers. As shown in FIG. 6, fill fiber 5*f* goes over one warp fiber and then under three warp fibers, and so on.

In FIG. 7, warp fibers 11*w*, 13*w*, 15*w*, 17*w* and 19*w* are of alternate "up and down" or "over and under" weave with respect to the fill yarns and are composed of organic cushioning fibers. The in-between warp fibers 12*w*, 14*w*, 16*w* and 18*w* do not exhibit the frequency of "over and under" pattern as the organic fibers and are glass fibers.

The adhesives used for securing the abrasive particles or granules to the fabrics of the present invention are those conventionally used in the manufacture of abrasive belts. Suitable adhesives are epoxy resins, acrylic resins, polyurethane resins, urea-formaldehyde resins, phenolic resins and mixtures thereof.

The abrasive particles utilized in the present invention are of conventional sizes and composition. Exemplary of the abrasives which can be used are aluminum oxide, silicon carbide, talc, cerium oxide, garnet, flint, emery and mixtures thereof.

The adhesive and the abrasive particles are applied to the fabrics of the present invention by conventional methods used in the production of abrasive belts. As discussed above, the fabrics to which the adhesive and the abrasive particles are applied are preferably first treated with an anchoring agent and then impregnated with a resin. The adhesive is typically applied to one side of the fabric by a rotating brush, or by spraying to form a coating. Excess adhesive can be removed by means of squeeze rollers. The abrasive is then sprinkled onto the wet adhesive coating and the coating is dryed and cured in a drying oven for times and at temperatures known in the art. The adhesive and abrasive particles can also be applied by passing the fabric through a bath of the adhesive, and removing excess adhesive by means of squeeze rollers, sprinkling on the adhesive particles and then drying and curing, as disclosed and shown in U.S. Pat. No. 2,740,239. The adhesive and the abrasive particles could be admixed to form a slurry and then applied to the fabric of the present invention. The fabric is passed through a two-roll coater to coat it with the slurry, the adhesive is cured and then the cured product is spray-coated with a final abrasive-adhesive slurry and dried and cured as disclosed in U.S. Pat. No. 3,688,453.

The fabric can be cut into strips and spliced into an endless belt either before or after the adhesive and abrasive particles are applied. However, it is more economical and preferable to continuously apply adhesive and abrasive to the fabric of the present invention which is unwound from rolls, and then form the endless abrasive belts.

In FIG. 8, an endless abrasive belt 20 is shown schematically as rotating in the clockwise direction. The belt 20 comprises a woven fabric 21, such as the one depicted in FIG. 1, having a coating 22 of an adhesive which contains abrasive particles. A cross section, viewed in direction 9—9 in FIG. 8, of a portion of the width of the belt 20 is shown in FIG. 9. In FIG. 9, organic cushioning fibers 30*w*, 32*w*, and 34*w* alternate with glass fibers 31*w*, 33*w*, and 35*w* in the warp direction. Organic filling fiber 30*f* goes under side-by-side warp fibers 30*w* and 31*w*, over side-by-side warp fibers 32*w* and 33*w* and under side-by-side warp fibers 34*w* and 35*w*. The fibers forming the fabric are coated with adhesive 40. The adhesive 40 bonds abrasive particles 50 to the fibers. As can be visualized from FIGS. 8 and 9, the endless abrasive belts are formed such that the alternating glass fibers (31*w*, 33*w* and 35*w*) and organic cushioning fibers (30*w*, 32*w*, and 34*w*) are oriented in the direction of rotation of the endless belt. As a result, the major tensional stresses during the abrading operation are borne by the glass fibers (31*w*, 33*w*, and 35*w*) having a sinuosity less than or equal to the sinuosity of the organic cushioning fibers in a given increment of length of the woven fabric.

As a result of the close to zero elongation and high strength achieved with the belts of the present invention, higher horsepower and higher speeds can be used in abrasive operations without belt breakage. Also, flatter, smoother belts are obtained, and more control for doing precision work without the need for costly milling operations can be achieved with the abrasive belts of the present invention.

The woven fabrics of the present invention can also be used in the manufacture of other articles where high strength, long life and close to zero elongation under tensional forces in one direction are desired. Other suitable applications for the fabrics of the present invention are in the manufacture of non-abrasive industrial belts, and as reinforcements for tires and other elastomeric articles.

I claim:

1. A woven fabric comprising glass fibers which are cushioned from each other along their length by organic fibers, the sinuosity of the glass fibers being less than or equal to the sinuosity of the organic fibers in a given length of the woven fabric, and organic fibers in the direction generally transverse to said glass fibers.

2. A woven fabric as claimed in claim 1 wherein said organic fibers which cushion the glass fibers are selected from the group consisting of cotton fibers, polyester fibers, polyester-cotton blend fibers, nylon fibers, wool, acrylic fibers, acetate fibers, and mixtures thereof.

3. A woven fabric as claimed in claim 1 wherein the organic fibers are textured yarns.

4. A woven fabric as claimed in claim 1 wherein the organic fibers are spun yarns.

5. A woven fabric as claimed in claim 1 wherein said organic fibers which are generally transverse to the glass fibers are selected from the group consisting of cotton fibers, polyester fibers, polyester-cotton blend fibers, nylon fibers, wool, acrylic fibers, acetate fibers and mixtures thereof.

6. A woven fabric as claimed in claim 1 wherein the alternating organic fibers and glass fibers are warp yarns, and said organic fibers in the direction generally transverse to the glass fibers are filling yarns.

7. A woven fabric as claimed in claim 6 wherein the organic fill yarns are 100% spun polyester yarns and the organic warp yarns are spun yarns of 50% cotton and 50% polyester.

8. A woven fabric as claimed in claim 1 wherein a glass fiber is substituted for every third, sixth, or twenty-fourth organic fiber in said transverse direction.

9. A woven fabric as claimed in claim 1 wherein said glass fibers are coated with a resin.

10. A woven fabric as claimed in claim 9 wherein said resin is an acrylic latex resin or a resorcinol-formaldehyde resin.

11. An abrasive comprising the woven fabric of claim 1, 2, 3, 4, 5, 6, 7, 8, 9, or 10 coated on at least one surface with an adhesive containing abrasive particles.

12. An abrasive as claimed in claim 11 which is in the form of an endless belt.

13. An abrasive as claimed in claim 11 wherein said adhesive is selected from the group consisting of epoxy resins, acrylic resins, polyurethane resins, and phenolic resins and mixtures thereof, and said abrasive particles are selected from the group consisting of aluminum oxide, silicon carbide, talc, cerium oxide, garnet, flint, emery and mixtures thereof.

* * * * *